US006926278B2

(12) United States Patent
Bibi

(10) Patent No.: US 6,926,278 B2
(45) Date of Patent: Aug. 9, 2005

(54) GAME TABLE HAVING A PIVOTING TABLE SECTION FOR CHESS AND BACKGAMMON AND HAVING STORAGE COMPARTMENTS THEREIN

(76) Inventor: Reuben Bibi, 2078 West St., Brooklyn, NY (US) 11223

( * ) Notice: Subject to any disclaimer, the term of this patent is extended or adjusted under 35 U.S.C. 154(b) by 0 days.

(21) Appl. No.: 10/681,912

(22) Filed: Oct. 9, 2003

(65) Prior Publication Data

US 2005/0077678 A1 Apr. 14, 2005

(51) Int. Cl.[7] ..... A63F 3/00
(52) U.S. Cl. ..... 273/284; 273/309
(58) Field of Search ..... 273/280, 283, 273/284, 287, 309; 473/10, 16; D21/397; 108/167; 272/280, 284, 309

(56) References Cited

U.S. PATENT DOCUMENTS 139,425 A * 5/1873 Schindler ..... 273/280
577,984 A * 3/1897 Horovitz ..... 273/280
3,001,843 A * 9/1961 Davis ..... 108/62
6,113,182 A * 9/2000 Wise ..... 297/119
6,764,409 B1 * 7/2004 Voden ..... 473/10

* cited by examiner

*Primary Examiner*—Vishu K Mendiratta
(74) *Attorney, Agent, or Firm*—Ezra Sutton, Esq.

(57) ABSTRACT

A game table for playing different types of games. The game table includes a frame section having a centrally-located opening with a rotatable table section mounted therein. The game table further includes a pair of pivot pins for rotating the table section being cooperatively mounted on the table section and the frame section for rotating the table section up to 360° relative to the frame section. The table section includes a first playing surface on the top surface thereof and a second playing surface on the bottom surface thereof; wherein the first and second playing surfaces include a first game board and a second and different game board, respectively, thereon. The frame section and the table section include a pull-out stop pin for retaining the table section in a horizontal plane relative to the frame section. The pull-out stop pin is movable between a retaining position and a non-retaining position for allowing the table section to rotate. Additionally, the frame section includes storage compartments on opposing sides of the opening in the frame section.

9 Claims, 7 Drawing Sheets

GAME TABLE HAVING A PIVOTING TABLE SECTION FOR CHESS AND BACKGAMMON AND HAVING STORAGE COMPARTMENTS THEREIN

FIELD OF THE INVENTION

The present invention relates to a game table having a pivoting table section for a game board on opposite sides of the table section. More particularly, each of the game boards can include games such as chess/checkers, chinese checkers, backgammon, scrabble, monopoly and the like.

BACKGROUND OF THE INVENTION

Game tables having table sections adapted to rotate about a longitudinal, central axis to utilize both surfaces for game boards or pool/billiard tables is disclosed in the prior art. These prior art rotatable game tables, pool/billiard tables, shuffleboard table, croquet table, card table and the like have complex designs and structures to prevent sagging caused by the increased weight of such tables. The pivoting systems for the aforementioned rotatable table sections are elaborate and complex because of the heavy weight of such tables. In general, these rotatable gaming tables have been overly complex with regard to storage, repair of the pivoting systems and retaining the game board surface in a horizontal plane.

There remains a need for a game table having a simple pivoting mechanism for rotating the table section in a clockwise or counterclockwise manner. Additionally, the game table should include a game board being disposed on opposite sides of the table section. Further, the table section should be detachably mounted within a centrally located opening of a frame section of the game table for changing to different game board sets.

DESCRIPTION OF THE PRIOR ART

Pivoting table sections having game boards, pool/billiards, shuffleboard, and the like having various designs, configurations, structures, functions and materials of construction have been disclosed in the prior art.

U.S. Pat. No. 122,830 to Heyl discloses a reversible billiard and croquet table. This pivotally mounted game table shows a billiard table on one side and a croquet table on the other side. This prior art patent does not disclose the structure and configuration of the present invention.

U.S. Pat. No. 211,083 to Bensinger discloses a combined billiard and dining table. This pivotally mounted gaming and dining table shows a billiard table on one side and a dining table on the other side. This prior art patent does not disclose the structure and configuration of the present invention.

U.S. Pat. No. 653,727 to Zentner discloses a combined pool and billiard table. This pivotally mounted game table shows a pool table on one side and a billiard table on the other side. This prior art patent does not disclose the structure and configuration of the present invention.

U.S. Pat. No. 4,365,803 to Barnes et al. discloses a game table. This pivotally mounted game shows a pool table on one side and a shuffleboard table on the other side. This prior art patent does not disclose the structure and configuration of the present invention.

None of the aforementioned prior art patents disclose or teach a game table having a simple pivoting table section for game boards on opposite sides of the table section. Further, none of the prior art patents disclose multiple top storage compartments within opposing sides of the table section.

Accordingly, it is an object of the present invention to provide a game table having a simple pivoting mechanism for a table section in order to rotate the table section in a clockwise or counterclockwise direction up to 360°.

Another object of the present invention is to provide a game table having a game board disposed on opposite sides of the table section being pivotally mounted within a centrally located opening of the game table.

Another object of the present invention is to provide a game table having a frame section with opposing storage compartments for holding game pieces (i.e. checkers, chess figures, backgammon discs, etc.) therein.

Another object of the present invention is to provide a game table having game boards mounted within opposing sides of the table section selected from the group consisting of chess/checkers, chinese checkers, backgammon, parcheesi, scrabble, monopoly, cards and the like.

Another object of the present invention is to provide a game table having the game board being held in a horizontal plane by a stop pin placed within adjacent openings within one side of the frame section and game board, respectively.

Another object of the present invention is to provide a game table having the table section within the frame section being detachably mounted in order to change a given pair of game boards with another set of game boards within the centrally located opening of the frame section.

Another object of the present invention is to provide a game table made from materials such as wood, metal, plastics or combinations thereof.

A further object of the present invention is to provide a game table that can be mass produced in an automated and economical manner and is readily affordable by the user.

SUMMARY OF THE INVENTION

In accordance with the present invention, there is provided a game table for playing different types of games. The game table includes a frame section having a centrally-located opening with a rotatable table section mounted therein. The game table further includes a pair of pivot pins for rotating the table section being cooperatively mounted on the table section and the frame section for rotating the table section up to 360° relative to the frame section. The table section includes a first playing surface on the top surface thereof and a second playing surface on the bottom surface thereof; wherein the first and second playing surfaces include a first game board and a second and different game board, respectively, thereon. The frame section and the table section include cooperative retaining means in the form of a pull-out stop pin for retaining the table section in a horizontal plane relative to the frame section. The pull-out stop pin is movable between a retaining position and a non-retaining position for allowing the table section to rotate. Additionally, the frame section includes storage compartments on opposing sides of the opening in the frame section.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings; wherein.

DETAILED DESCRIPTION OF THE PREFERRED EMBODIMENT

Figure 2:
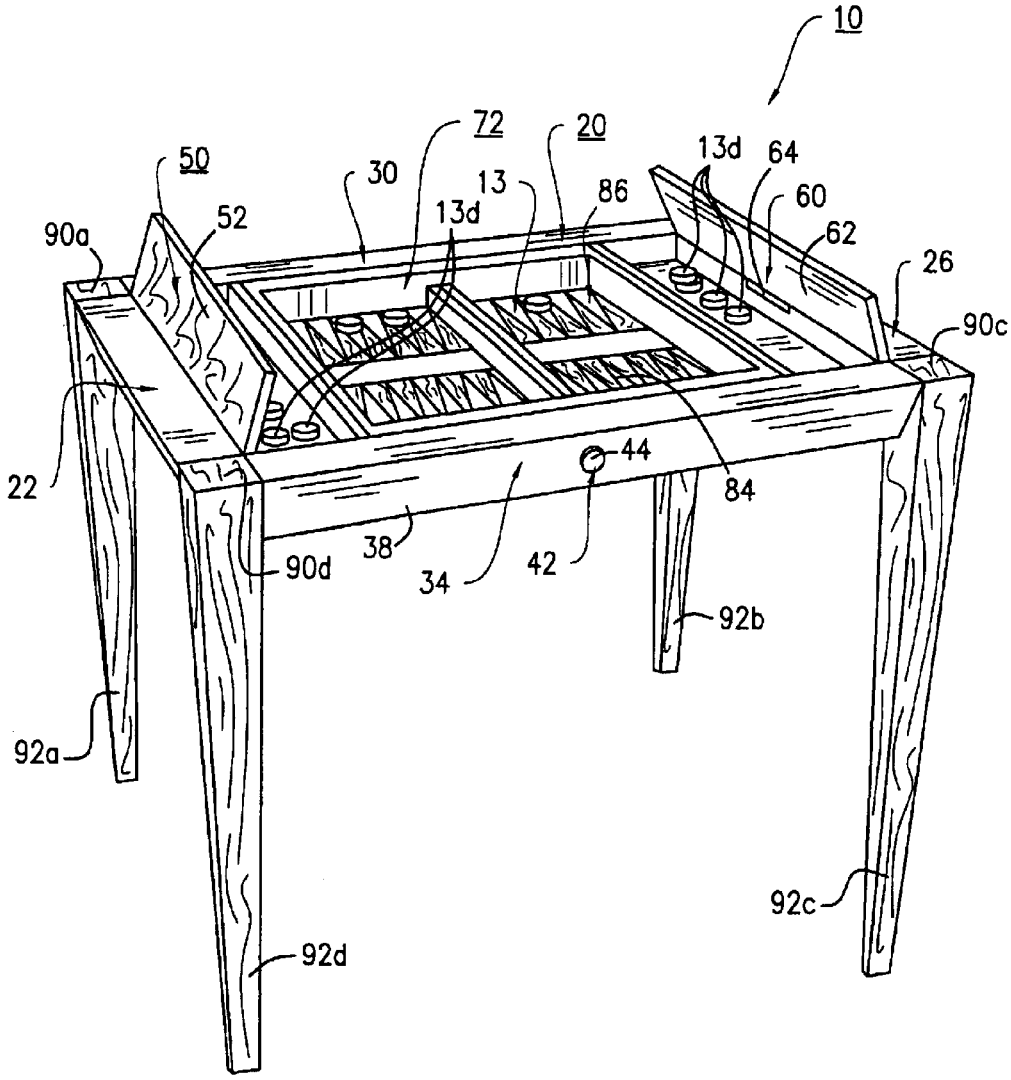
FIG. 2 is a top perspective view of the game table of the present invention showing the other side of the table section having a backgammon game board in operational use and a pair of opposing storage compartments having backgammon discs therein.
Figure 3:
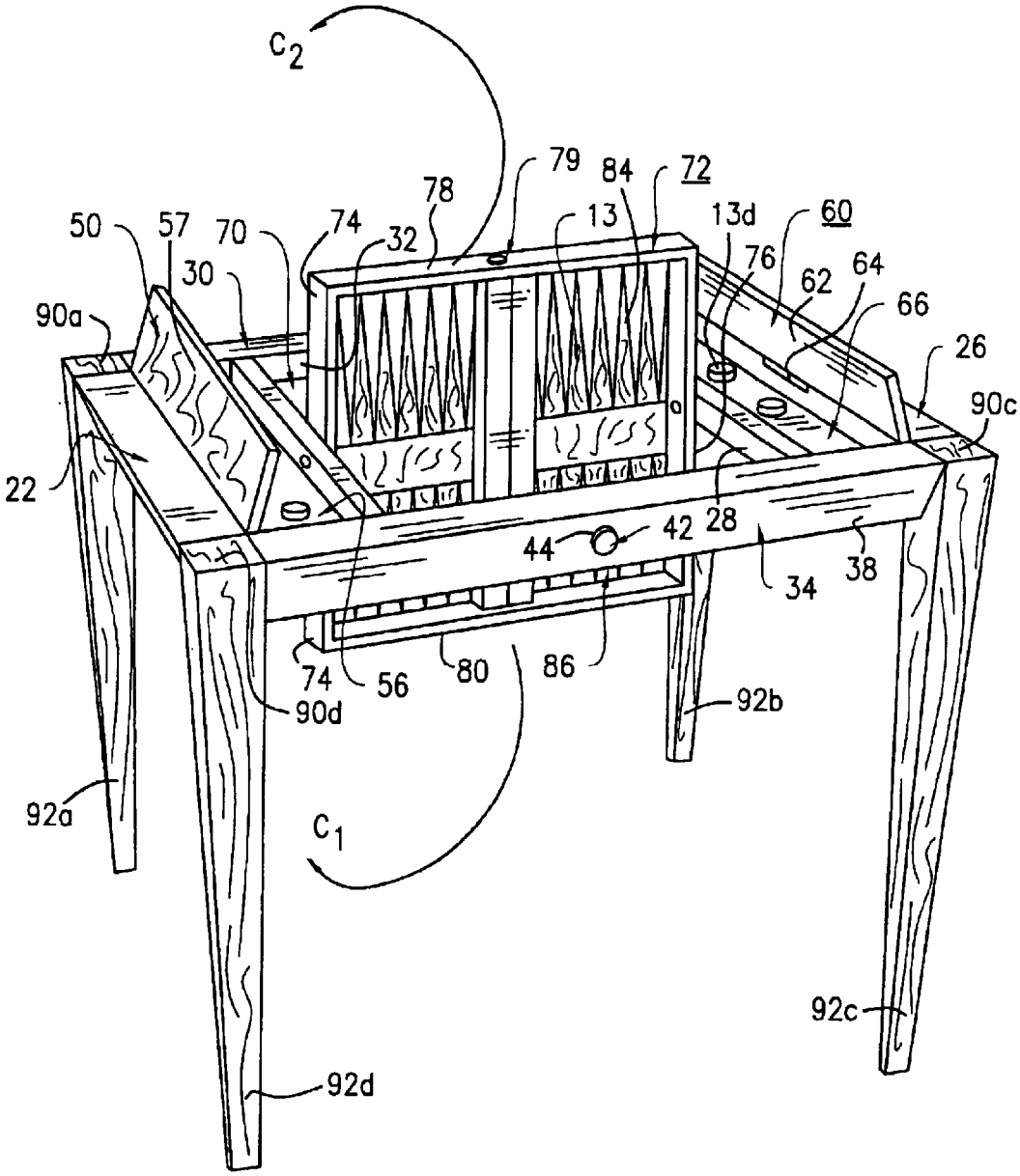
FIG. 3 is a top perspective view of the game table of the present invention showing the game board being rotated within a centrally located opening of a frame section of the game table.
Figure 4:
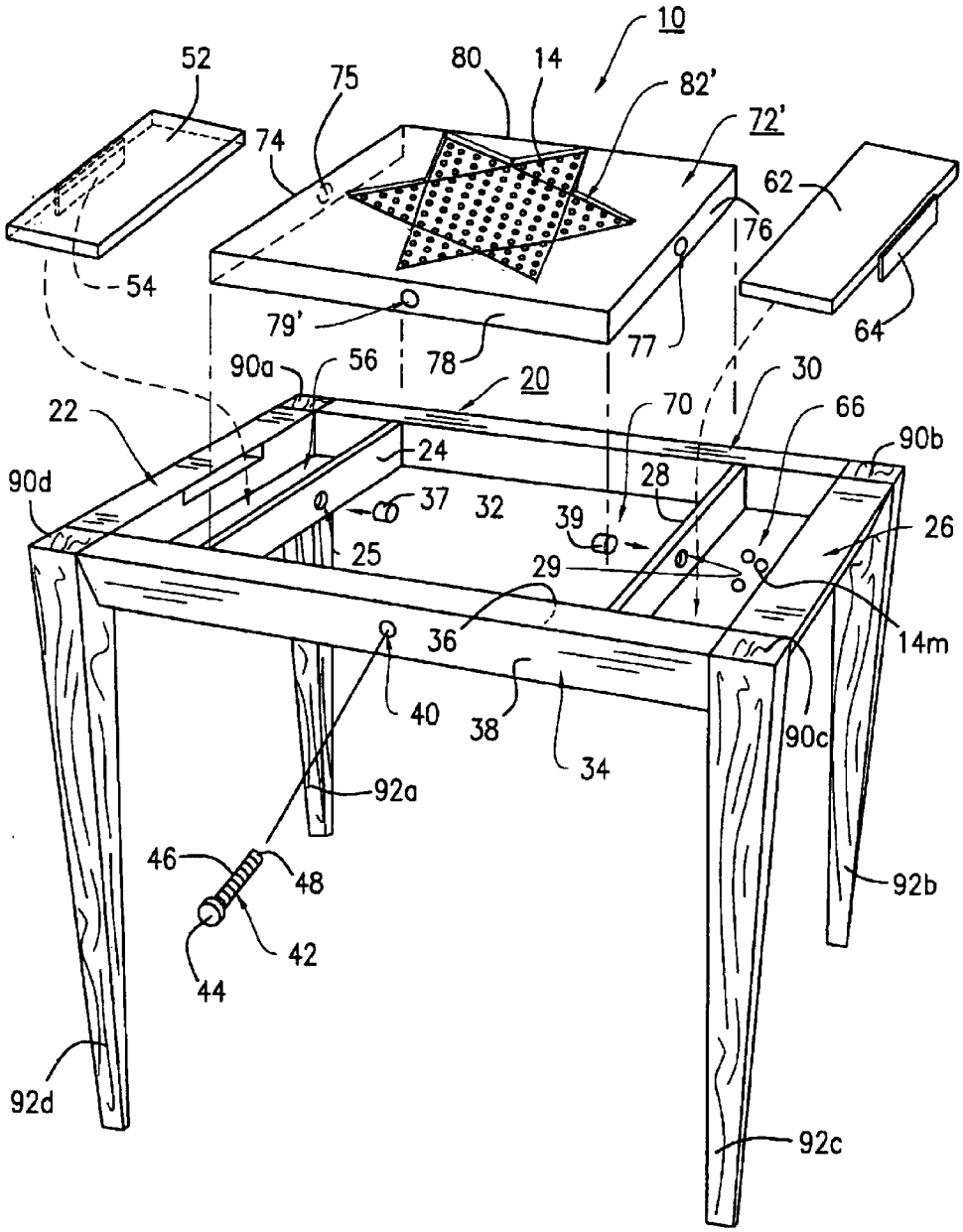
FIG. 4 is a top exploded perspective view of the game table of the present invention showing another game board being detachably mounted within the centrally located opening of the frame section of the game board.
Figure 5:
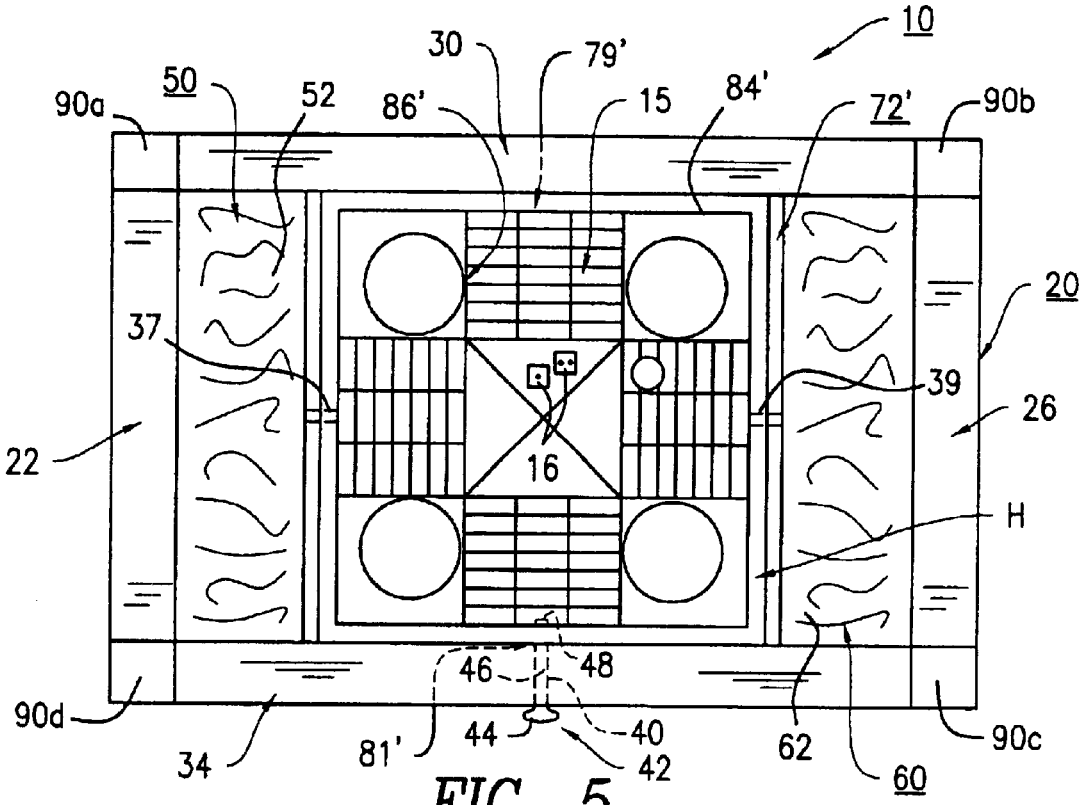
FIG. 5 is a top plan view of the game table of the present invention showing a pair of pivoting pins for rotating the table section within the centrally located opening and a pull-out stop pin for holding the game board in a horizontal position relative to the frame section of the game table.

A game table 10 having a pivoting table section 72 is represented in detail by FIGS. 1 through 7 of the patent drawings. The game table 10 is used for playing various games on a game board such as chess/checkers 12, backgammon 13 and the like. The game table 10, as shown in FIGS. 3 to 5 and 7 of the drawings, include a frame section 20 having a first section 22, a second section 26, a third section 30 and a fourth section 34. The first section 22 includes a first interior side wall surface 24 having a first centrally-positioned pivot pin opening 25 therein. The second section 26 includes a second interior side wall surface 28 having a second centrally-positioned pivot pin opening 29 therein. The third section 30 includes a third interior side wall surface 32. The fourth section 34 includes fourth interior and exterior side wall surfaces 36 and 38, respectively, as depicted in FIG. 4 of the drawings. The first centrally-positioned pivot pin opening 25 is used for receiving a first spring actuated pivot pin 37 therein. The second centrally-positioned pivot pin opening 29 is used for receiving a second spring actuated pivot pin 39 therein. The fourth exterior and interior side wall surfaces 38 and 36, respectively, include a centrally-positioned stop pin opening 40 for receiving a pull-out stop pin 42 therethrough, as shown in FIGS. 4 and 5 of the drawings. The pull-out stop pin 42 includes a knob member 44, a stem section 48 and an end tip 48.

The frame section 20, as shown in FIGS. 2 to 4, also includes a first storage compartment 50 and a second storage compartment 60 therein. The first storage compartment 50 includes a first compartment lid 52 having a first hinge element 54 thereon and having a first interior space 56 for storing of game pieces 13*d* therein. The second storage compartment 60 includes a second compartment lid 62 having a second hinge element 64 thereon and having a second interior space 66 for storing of game pieces 13*d* therein.

The frame section 20, as shown in FIGS. 3 and 4, further includes a centrally-located opening 70 for receiving a detachably mounted and rotatable table section 72 therein. The table section 72 includes a first table section side wall surface 74, a second table section side wall surface 76, a third table section side wall surface 78 and a fourth table section side wall surface 80. The first table section side wall surface 74 includes a third centrally-positioned pivot pin opening 75 therein for receiving the first spring actuated pivot pin 37 therein. The second table section side wall surface 76 includes a fourth centrally-positioned pivot pin opening 77 therein for receiving the second spring actuated pivot pin 39 therein. In the assembled configuration, as shown in FIGS. 3 and 5 to 7, the first and third centrally-positioned pivot pin openings 25 and 75 are adjacent to each other having the first spring actuated pivot pin 37 therein, and the opposing second and fourth centrally-positioned pivot pin openings 29 and 77 are adjacent to each other having the second spring actuated pivot pin 39 therein. This allows the table section 72 of game table 10 to pivot and rotate in a clockwise $C_1$ or counterclockwise $C_2$ direction, as depicted in FIG. 3 of the patent drawings. The third table section side wall surface 78 includes a first centrally-positioned side wall stop pin opening 79 for receiving the end tip 48 of the pull-out stop pin 42 therethrough. Also, the fourth table section side wall surface 80 includes a second centrally-positioned side wall stop pin opening 81 for receiving the end tip 48 of the pull-out stop pin 42 therethrough. This allows the table section 72 to remain in a horizontal plane H relative to the frame section 20 when the end tip 48 of the stop pin 42 is positioned within one of stop pin openings 79 or 81 and the stop pin opening 40, as shown in FIGS. 1, 2, 4 and 5 of the patent drawings.

Figure 1:
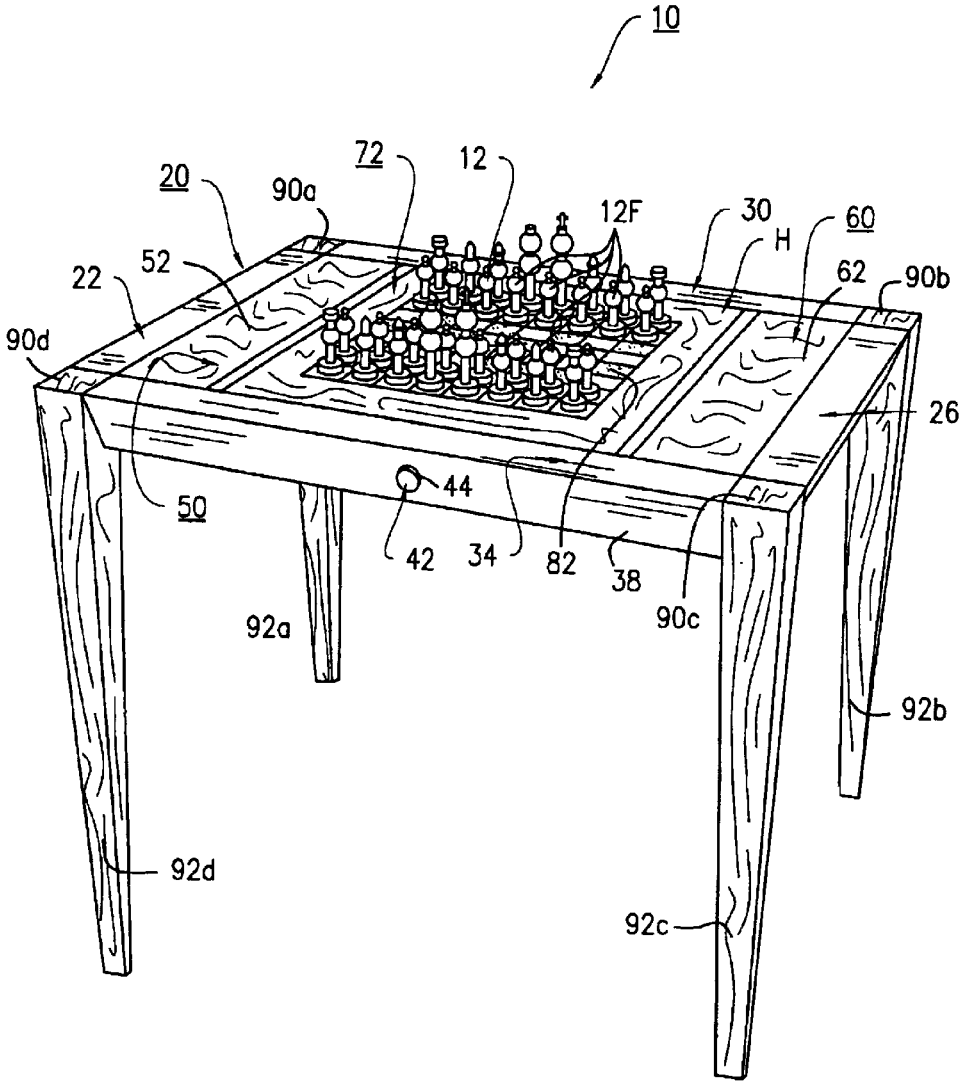
FIG. 1 is a top perspective view of the game table having a pivoting table section of the preferred embodiment of the present invention showing one side of the table section having a chess game board in operational use.

The table section 72, as shown in FIGS. 1 through 3, also includes a first playing surface 82 having a chess/checker game board 12 thereon and a second playing surface 84 having an interior compartment 86 (recessed well) for retaining a backgammon game board 13 therein. In an alternate embodiment, as shown in FIGS. 4 and 5, the table section 72' includes a first playing surface 82' having a chinese checker game board 14 thereon and a second playing surface 84' having an interior compartment 86' for retaining a parcheesi game board 15 therein. The interior compartments or recessed wells 86 and 86' allow for the dice 16 not to fall-off the game boards 13 and 15 as the games are being played by the participants. It is understood that multiple different pairs of game boards can be placed on table section 72, such that any paired combination having game boards mounted within opposing playing surfaces 82 and 84 can include games selected from the group consisting of chess/checkers, chinese checkers, backgammon, parcheesi, scrabble, monopoly, cards, tic tac toe and other games. These paired combinations of game boards are able to be detachably mounted within the centrally-located opening 70 of frame section 20 at the choice of the participating players involved.

Figure 7:
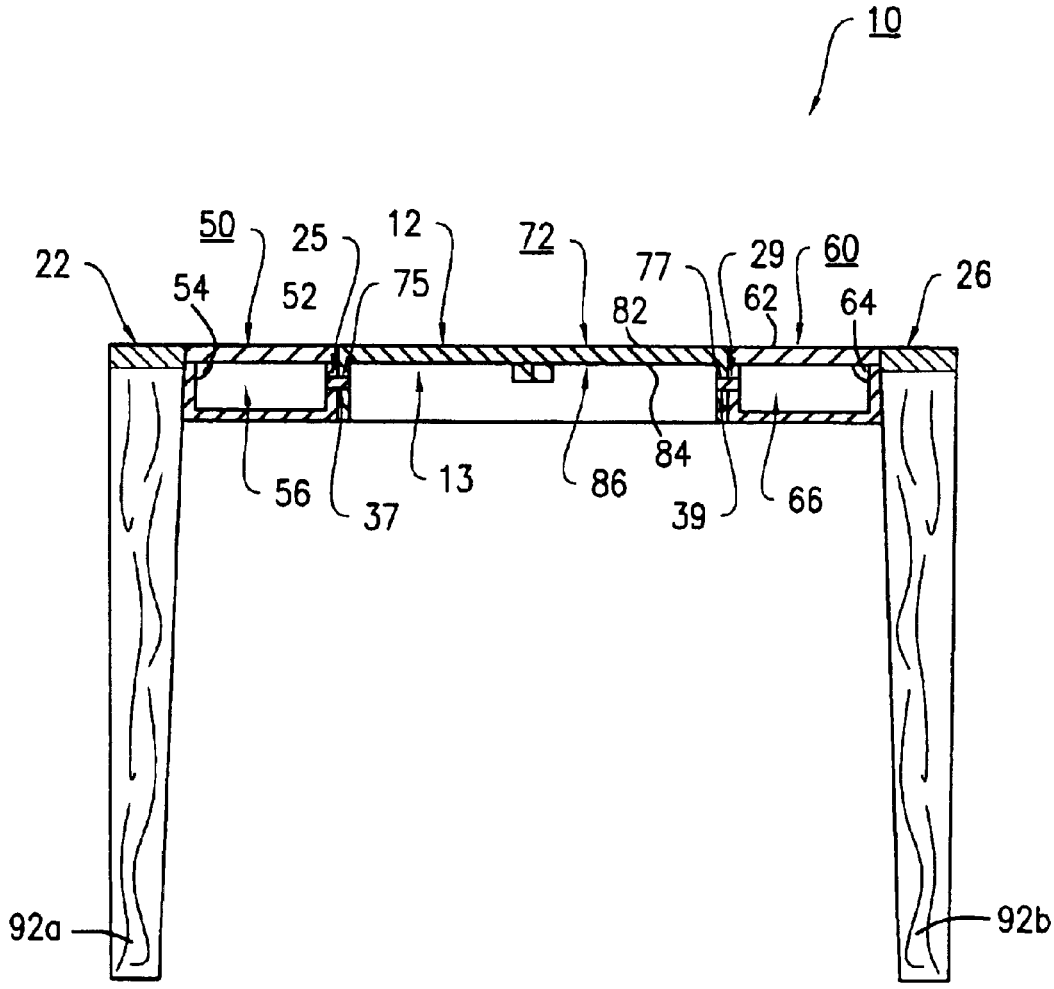
FIG. 7 is a cross-sectional view of the game table of the present invention taken along lines 7—7 of FIG. 1 in the direction of the arrows showing the opposing storage compartments, the opposing pivoting pins, the game board and the frame section.
Figure 8A:
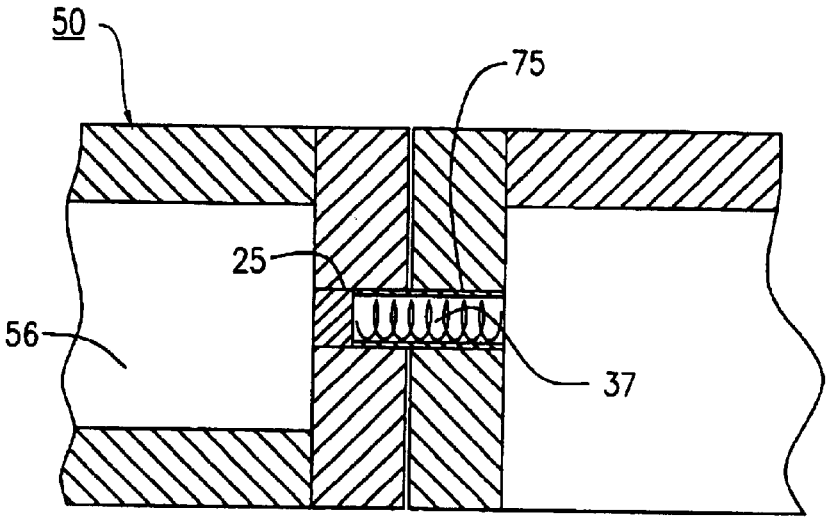
FIG. 8*a* is an enlarged cross-sectional view of the game table of the present invention showing the pivot pin received within the pivot pin openings on one of the opposing sides of the table section and frame section.
Figure 8B:
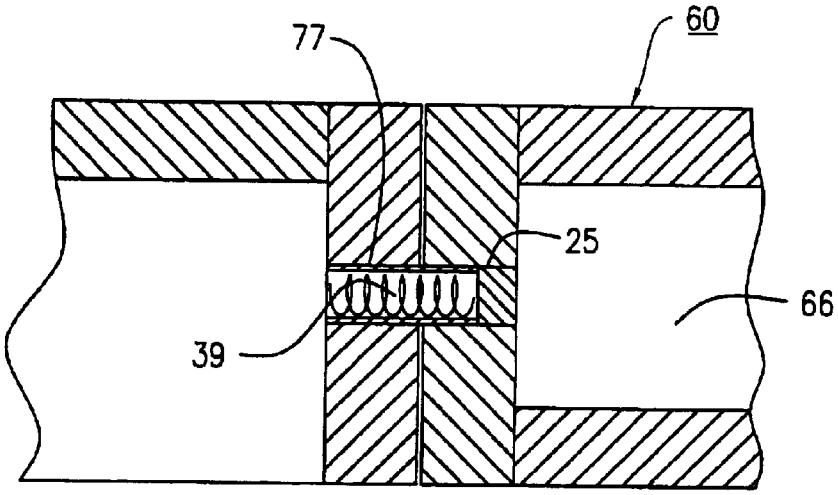
FIG. 8*b* is an enlarged cross-sectional view of the game table of the present invention showing the pivot pin received within the pivot openings on the other opposing side of the table section and frame section.

The frame section 20 of game table 10, as shown in FIGS. 1, 3 and 7, also includes corner sections 90*a*, 90*b*, 90*c* and 90*d*, each having a support leg 92*a*, 92*b*, 92*c* and 92*d* attached thereto, respectively. Support legs 92*a* to 92*d* can be foldable allowing the game table 10 to be folded into a compact table for storage when not in use. The game table 10 is made from materials selected from the group consisting of hardwoods, light-weight and durable plastics and light-weight metals.

OPERATION OF THE PRESENT INVENTION

In operation, the game table 10 operates in the following manner, as shown in FIGS. 1, 2 and 3 of patent drawings. The participating game players first choose a particular game board, such as the chess game board 12 on one of the playing surfaces 82 of table section 72. If the playing surface 82 is not facing the participating players, one of the players now removes the pull-out stop pin 42 via the knob member 44 from the stop pin openings 81 and 40, respectively, as shown in FIG. 3 to 5 of the drawings. The player then rotates the table section 72 in a clockwise $C_1$ or counterclockwise $C_2$ direction via the pivot pins 37 and 39 in order to bring the playing surface 82 in an upward facing direction, such that the chess game board 12 is now in a position to be played on. The game player re-inserts the pull-out stop pin 42 into stop pin openings 40 and 79, respectively, such that the tip end 48 of stop pin 42 is received within the stop pin opening 79. In this manner, the table section 72 is allowed to remain in a horizontal plane H relative to the horizontal frame section 20 and the chess game board 12 of game table 10. Each player then removes the chess FIG. 12*f* from their respective storage interior spaces 56 and 66 of storage compartments 50 and 60, respectively. The players place the chess FIG. 12*f* on the chess game board 12, as shown in FIG. 1, and the game players can now proceed with their chess game.

If the participating game players would like to change their chess game board 12 to a backgammon game board 13, the first step, would be to remove the chess FIG. 12*f* from the game board playing surface 82 of chess game board 12, as well as to remove the chess FIG. 12*f* from their respective interior storage spaces 56 and 66 of storage compartments 50 and 60, respectively, to an off board container (not shown) to store the chess FIG. 12*f*. The players now proceed to place the backgammon discs 13*d* into their respective interior storage spaces 56 and 66, respectively. One of the participating game players now removes the pull-out stop pin 42 via the knob member 44 from the stop pin openings 79 and 40, respectively. Then one of the players rotate the table section 72 in a clockwise $C_1$ or counterclockwise $C_2$ direction about the pivot pins 37 and 39 in order to bring the playing surface 84 in an upward facing direction, such that the backgammon game board 13 is now in a position to be played on. The player then re-inserts the pull-out stop pin 42 into the stop pin openings 40 and 81 respectively, such that the tip end 48 of stop pin 42 is received within the stop pin opening 81. In this manner, the table section 72 is allowed to remain in a horizontal plane H relative to the horizontal frame section 20 and the backgammon game board 12 of game table 10. Each player then removes the backgammon discs 13*d* from their respective interior storage spaces 56 and 66 of storage compartments 50 and 60, respectively. The players now place the backgammon discs 13*d* on the backgammon game board 13, as shown in FIG. 2, and the game players can now proceed with their backgammon game.

Figure 6:
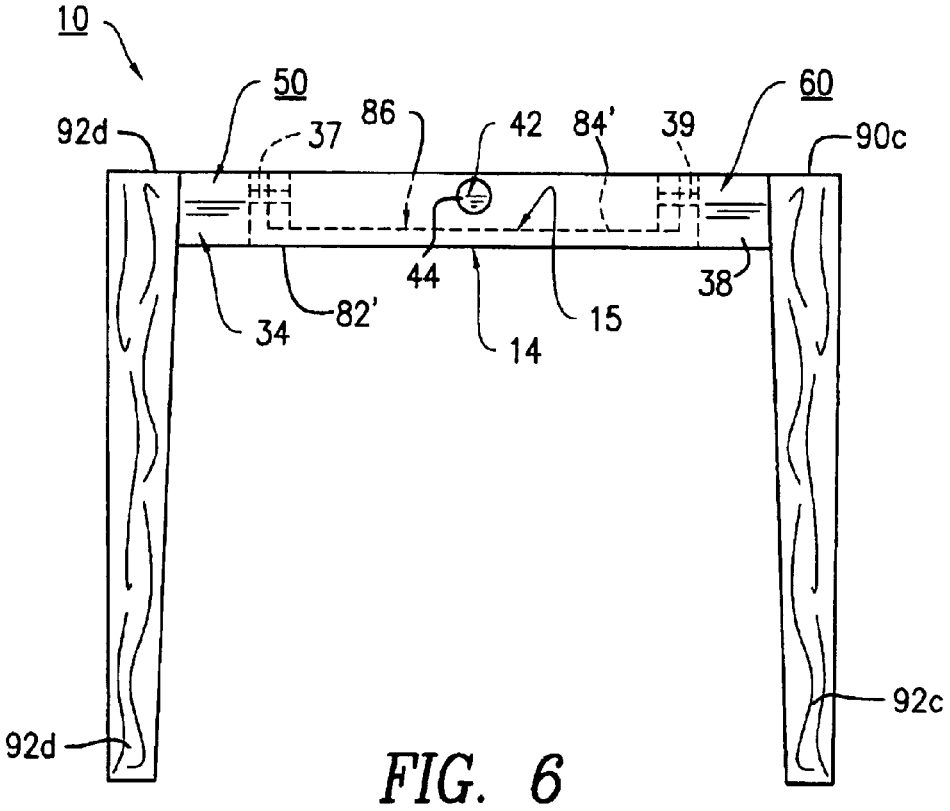
FIG. 6 is a front elevational view of the game table of the present invention showing the opposing storage compartments, the opposing pivoting pins within the game board, and the pull-out stop pin.

If the participating players would like to change to another table section 72' as shown in FIGS. 4, 5 and 6 of the patent drawings, having a different pair of game boards 14 and 15 thereon, such as playing surface 82 being a chinese checker game board 14 and a parcheesi game board 15. In order to remove the table section 72, the player would again remove the pull-out stop pin 42 from stop pin openings 81 and 40, respectively, and then depress inwardly each of pivot pins 37 and 39. The table section 72 can now be detachably removed from the centrally-located opening 70 of frame section 20, such that the replacement table section 72' is then detachably mounted within the centrally located opening 70 of frame section 20 via pivot pins 37 and 39. Depending upon whether the players want to play chinese checkers 14 or parcheesi 15, one of the players then re-inserts the pull-out stop pin 42 within stop pin openings 40 and 79' or within stop pin opening 40 and 81', accordingly. In this manner, the table section 72' is allowed to remain in a horizontal plane H relative to the horizontal frame section 20 with the chinese checker game board 14 or the parcheesi game board 15 of game table 10, depending upon which game the players want to play.

ADAVANTAGES OF THE PRESENT INVENTION

Accordingly, an advantage of the present invention is that it provides for a game table having a simple pivoting mechanism for a table section in order to rotate the table section in a clockwise or counterclockwise direction up to 360°.

Another advantage of the present invention is that it provides for a game table having a game board disposed on opposite sides of the table section being pivotally mounted within a centrally located opening of the game table.

Another advantage of the present invention is that it provides for a game table having a frame section with opposing storage compartments for holding game pieces (i.e. checkers, chess figures, backgammon discs, etc.) therein.

Another advantage of the present invention is that it provides for a game table having game boards mounted within opposing sides of the table section selected from the group consisting of chess/checkers, chinese checkers, backgammon, parcheesi, scrabble, monopoly, cards and the like.

Another advantage of the present invention is that it provides for a game table having the game board being held in a horizontal plane by a stop pin placed within adjacent openings within one side of the frame section and game board, respectively.

Another advantage of the present invention is that it provides for a game table having the table section within the frame section being detachably mounted in order to change a given pair of game boards with another set of game boards within the centrally located opening of the frame section.

Another advantage of the present invention is that it provides for a game table made from materials such as wood, metal, plastics or combinations thereof.

A further advantage of the present invention is that it provides for a game table that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A game table for playing different types of games, comprising, a) a game table having a frame section in a horizontal plane;

b) said frame section including a centrally-located opening having a detachably mounted and rotatable table section therein;

c) means for rotating said table section being cooperatively mounted on said table section and said frame section for rotating said table section up to 360° relative to said frame section;

d) said table section having a first playing surface on the top surface thereof and a second playing surface on the bottom surface thereof; said table section having an axis of rotation in said horizontal plane; wherein said first and second playing surfaces include a first game board and a second and different game board, respectively, thereon;

e) said frame section and said table section including cooperative means for retaining said table section in said horizontal plane relative to said frame section; said retaining means being movable between a retaining position and a non-retaining position for allowing said table section to rotate; and f) said frame section having a first storage compartment and a second storage compartment disposed on opposite sides of said opening in said table section; wherein said storage compartments, said opening and said axis of rotation of said table section in said frame section are in said same horizontal plane; and wherein said first and second storage compartments include first and second compartment lids each having a hinge for opening said first and second compartment lids.

2. A game table in accordance with claim 1, wherein said means for rotating said table section include a first spring actuated pivot pin and a second spring actuated pivot pin, and first and second pivot pin openings on opposing sides of said table section for receiving said first and second pivot pins therein, respectively.

3. A game table in accordance with claim 1, wherein said means for retaining said table section in a horizontal plane relative to said frame section includes a single pull-out stop pin being detachably mounted within first and second stop pin openings of said frame section and said table section, respectively.

4. A game table in accordance with claim 1, wherein said means for rotating said table section includes said first and second spring actuated pivot pins for allowing said table section to rotate in a clockwise or counterclockwise direction.

5. A game table in accordance with claim 1, wherein said frame section includes a plurality of foldable support legs on respective corners of said frame section for supporting said frame section on a floor area.

6. A game table in accordance with claim 1, wherein one of said first or second playing surfaces includes a recessed well having side walls for allowing the throwing of dice into said recessed well without the dice falling off of said playing surface.

7. A game table in accordance with claim 1, wherein said first and second game boards on said first and second playing surfaces, respectively, are selected from the group consisting of chess/checkers, backgammon, chinese checkers, parcheesi, scrabble, monopoly, playing cards and other board games.

8. A game table in accordance with claim 1, wherein said game table is made of materials selected from the group consisting of hardwood, light-weight and durable plastics and light-weight metals.

9. A game table in accordance with claim 1, wherein said first and second playing surfaces each have dimensions less than 36 inches by 36 inches.

* * * * *